United States Patent [19]

Yoshida et al.

[11] 4,425,895

[45] Jan. 17, 1984

[54] AIR-FUEL RATIO FEEDBACK CONTROL SYSTEM

[75] Inventors: Shuzo Yoshida, Anjo; Hironobu Ono, Toyota; Masashi Matsuo, Toyota; Kouich Hoshi, Toyota; Motoharu Sueishi, Toyota; Kazuo Ueda, Kariya, all of Japan

[73] Assignees: Nippondenso Co., Ltd., Kariya; Toyota Jidosha Kogyo Kabushiki Kaisha, Toyota, both of Japan

[21] Appl. No.: 294,823

[22] Filed: Aug. 21, 1981

[30] Foreign Application Priority Data

Sep. 3, 1980 [JP] Japan ..... 55-122755

[51] Int. Cl.[3] ..... F02D 5/00

[52] U.S. Cl. ..... 123/489; 123/440

[58] Field of Search ..... 123/440, 489, 492, 493, 123/589; 60/276, 285

[56] References Cited

U.S. PATENT DOCUMENTS 4,040,394 8/1977 Wahl et al. ..... 123/440
4,111,162 9/1978 Norimatsu et al. ..... 123/440
4,131,091 12/1978 Asano et al. ..... 123/440
4,173,952 11/1979 Asano ..... 123/440
4,178,884 12/1979 Norimatsu et al. ..... 123/489
4,251,989 2/1981 Norimatsu et al. ..... 123/489

FOREIGN PATENT DOCUMENTS 56-12032 2/1981 Japan ..... 123/440

*Primary Examiner*—Andrew M. Dolinar
*Attorney, Agent, or Firm*—Cushman, Darby & Cushman

[57] ABSTRACT

An air-fuel ratio feedback control system for the internal combustion engine produces a fuel supply control signal by delaying a rich or lean signal obtained by comparing the oxygen concentration in the exhaust gas with a reference value. The turning on of an idle switch operatively connected with the engine throttle valve, a predetermined time after the turning off of the idle switch and the engine speed included in a predetermined region are detected in order to delay the rich or lean signal to rich or lean side by an optimum delay time as selected according to the engine operating conditions, thus feedback controlling the amount of fuel supply.

7 Claims, 5 Drawing Figures

| PERIOD | (1) | (2) | (3) | (4) |
|---|---|---|---|---|
| $S_1$ | OFF | ON | ON | OFF |
| $S_2$ | OFF | ON | OFF | ON |
| $T_R$ | $T_R(1)$ | $T_R(1) < T_R(2)$ | $T_R(2) = T_R(3)$ | $T_R(1) = T_R(4)$ |
| $T_L$ | $T_L(1)$ | $T_L(1) < T_L(2)$ | $T_L(1) = T_L(3)$ | $T_L(2) = T_L(4)$ |

AIR-FUEL RATIO FEEDBACK CONTROL SYSTEM

BACKGROUND OF THE INVENTION

The present invention relates to an air-fuel ratio feedback control system of an electronic fuel supply control apparatus, in which the output of an oxygen sensor disposed in an engine exhaust manifold is fed back to control the time width of a supply pulse for determining the amount of fuel supply and to control the air-fuel ratio constant, more in particular to such an air-fuel ratio feedback control system effectively used with a three-way catalyst for purification of the exhaust gas.

Conventional systems of this type comprise an oxygen sensor for detecting the air-fuel ratio from the oxygen of the exhaust gas, or especially, the oxygen concentration of the exhaust gas of the engine, a comparator circuit for determining whether or not the air-fuel ratio is higher than a stoichiometric air-fuel ratio on the basis of an output signal from the oxygen sensor, a delay circuit for delaying the output signal of the comparator circuit for a predetermined time, and an integrator circuit for performing an integration in accordance with the output of the delay circuit, whereby the air-fuel ratio is corrected to the stoichiometric value, thus improving the purification rate of the three-way catalyst. Conventionally, the air-fuel ratio has been generally feedback controlled to rich or lean side by the delay circuit thereby to attain a high purification of the exhaust gas composition under the steady and transient operating conditions of the engine.

It has been found, however, that the delay time of the delay circuit has a close relation with the operating conditions of the engine or specifically with the amount of the intake air into the engine and the engine rotational speed. The optimum delay time required of the delay circuit under a high-load and high-speed condition where the amount of intake air for each revolution of the engine is great is different from that under the idling or decelerating condition where the amount of intake air for each revolution of the engine is small. If the delay time is unnecessarily long, the error between the actual air-fuel ratio and the stoichiometric air-fuel ratio becomes excessive.

SUMMARY OF THE INVENTION

The present invention has been developed in view of the above-mentioned problem, and an object thereof is to provide an air-fuel ratio feedback control system wherein the delay circuit includes delay-time changing means for changing a delay time in priority in response to the on-state of an idle switch or in response to a signal supplied from an idle-off timer circuit for detecting a predetermined length of time after the turn-off of the idle switch, which is operatively connected to the throttle valve to detect the full closed state of the throttle valve. The system according to the invention further comprises an engine speed detector circuit the output of which is used to change the delay time through the delay time changing means in accordance with the engine speed. In this way, an optimum delay time is variably set in all operating regions including high-load or high-speed operation and low-load or low-speed operation, idling time, deceleration or for a predetermined length of time after acceleration. The air-fuel ratio indication signal obtained depending on the output of the oxygen sensor is appropriately delayed to rich or lean side thereby to feedback control the air-fuel ratio to rich or lean side as desired, thus realizing a higher purification of the exhaust gas composition under the engine steady and transient states.

DESCRIPTION OF THE PREFERRED EMBODIMENTS

Figure 1:
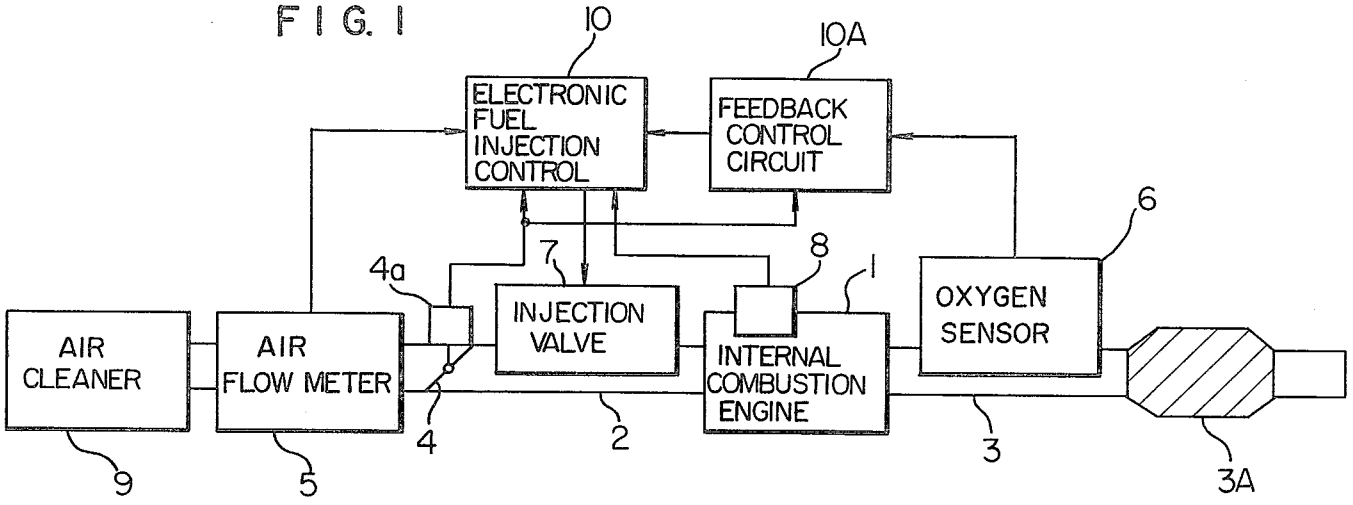
FIG. 1 is a block diagram showing an air-fuel ratio feedback control system.

An embodiment of the present invention shown in the drawings will be described. In the block diagram of FIG. 1 showing a fuel injection control system, reference numeral 1 designates an internal combustion engine proper, numeral 2 an intake pipe, 3 an exhaust manifold, and numeral 4 a throttle valve disposed in the intake pipe 2 and associated with an idle switch 4*a* for detecting the full closed state of the throttle valve 4. Numeral 5 designates an air flow meter for metering the amount of air introduced into the engine, which flow meter is mounted on the front of the intake pipe 2, and numeral 6 designates an oxygen sensor made of a solid electrolyte such as zirconia disposed into the exhaust manifold 3 for detecting the oxygen concentration in the exhaust gas, which oxygen concentration corresponds to the air-fuel ratio of the air-fuel mixture. When the temperature of the exhaust gas exceeds the tolerable temperatures of 450° C. to 600° C., the normal operation of the oxygen sensor 6 is started to generate a signal representing the oxygen concentration. Numeral 7 designates an injection valve for injecting the fuel into the intake pipe 2. Numeral 8 designates an engine condition detector means for detecting the engine conditions such as the engine speed, and numeral 9 designates an air cleaner.

Numeral 10 designates an electronic fuel injection control apparatus which produces a fuel injection pulse signal of a predetermined time width for opening the injection valve 7 in order to supply through the injection valve 7 the fuel of an amount commensurate with the output of the air flow meter 5 mounted on the front of the intake pipe 2. Numeral 10A designates a feedback control circuit for correcting by feedback the amount of fuel injection by the electronic fuel injection control apparatus 10 in response to the concentration detection signal generated by the oxygen sensor 6 arranged in the exhaust manifold 3. When the output of the feedback control circuit 10A coincides with a reference voltage of half the source voltage +B, the control circuit is operated at the reference voltage +B/2 to reduce the amount of correction of the feedback control system, thus injecting a predetermined basic amount of fuel. The feedback control circuit 10A, therefore, is such that when the output thereof is lower than the reference voltage +B/2, the time width of the fuel injection pulse is reduced, whereas when the output of the feedback control circuit 10A is higher than the reference voltage +B/2, the time width of the fuel injection pulse is lengthened thereby to correct the amount of fuel injection. Numeral 3A designates a catalyst or specifically a three-way catalyst which has an air-fuel ratio region ensuring a high purification rate of the three components of nitrogen oxide NOx, hydrocarbon HC and carbon monoxide CO in the exhaust gas near the stoichiometric air-fuel ratio where the normalized air-fuel ratio is 1.

Figure 2:
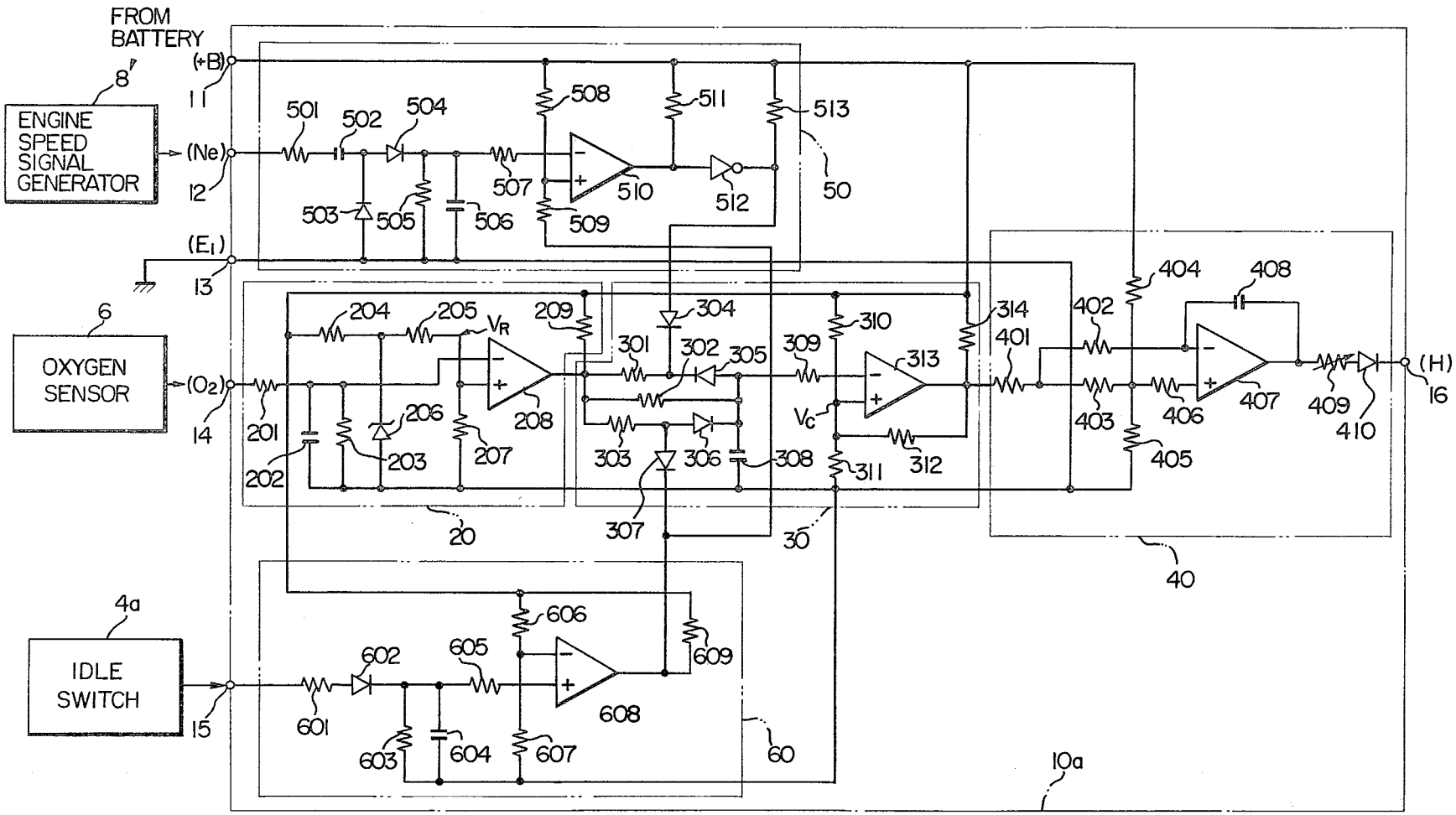
FIG. 2 is a feedback control circuit making up the essential parts of the present invention.

A detailed configuration of the feedback control circuit 10A making up an essential part of the present invention will be described. The feedback control circuit 10A making up the essential part of the present invention is shown in FIG. 2. In FIG. 2, numeral 11 designates a battery DC power terminal (+B), numeral 12 a terminal impressed with an engine rotational speed signal Ne of the engine speed signal generator S', numeral 13 a grounding terminal E1, numeral 14 a terminal supplied with an oxygen detection signal from the oxygen sensor 6, numeral 15 a terminal impressed with an output signal of the idle switch 4*a* of the throttle sensor, and numeral 16 a terminal H for supplying a signal H to command the increase or decrease of supplied fuel amount. Numeral 20 designates an air-fuel ratio discriminate circuit for discriminating on the air-fuel ratio indicated by the oxygen sensor, which air-fuel ratio discriminating circuit produces low and high level signals for the rich and lean states of the air-fuel ratio respectively. The high level substantially corresponds to the power potential level +B and the low level nearly to the ground level EI. Numeral 30 designates a delay circuit for delaying the output signal of the air-fuel ratio discriminating circuit, and numeral 40 an integrator circuit for generating an integrated output increasing or decreasing with the output of the delay circuit 30. The output of the integrator circuit 40 is applied to the succeeding fuel-amount charging section not shown in the drawing from the above-mentioned terminal (H) 16. Numeral 50 designates an engine speed detector circuit for detecting a predetermined speed of the engine. Numeral 60 designates an idle-off timer circuit for producing a high level for a predetermined length of time after turning on or off of the idle switch. In the air-fuel ratio discriminating circuit 20, numerals 201 and 203 are input resistors for the comparator 208, numeral 202 a noise-erasing capacitor, numeral 204 a resistor, numeral 206 a zener diode, and 205 and 207 dividing resistors for dividing the Zener voltage into a fixed voltage $V_R$. Numeral 209 designates a pull-up resistor for the comparator 208. In the delay circuit 30, numeral 308 designates a charge-discharge capacitor, numerals 301, 302 and 303 charging or discharging resistors, numerals 305 and 306 reverse cut-off diodes, numerals 304 and 307 diodes for controlling the charging or discharging current, numeral 309 an input resistor for the comparator 313, numerals 310 and 311 dividing resistors, numeral 312 a hysteresis resistor, and numeral 314 a pull-up resistor for the comparator 313.

In the integrator circuit 40, numerals 401, 403 and 406 designate input resistors for the integrator 407, numerals 404 and 405 resistors for setting a middle-point potential, numeral 408 an integrating capacitor, numeral 409 a resistor for setting the amount of increased or decreased fuel, and numeral 410 a reverse cut-off diode. In the engine speed detector circuit 50, numeral 501 designates an input resistor for the coupling capacitor 502, numerals 503 and 504 rectifying diodes, numeral 505 a discharge resistor, numeral 506 a rectifying capacitor, numeral 507 an input resistor for the comparator 510, numerals 508 and 509 resistors for setting the engine speed level, and numerals 511 and 513 pull-up resistors for the comparator 510 and the inverter 512 respectively, the inverter 512 producing a high level signal at an engine speed of a predetermined level or higher.

In the idle off timer circuit 60, numeral 601 designates an input resistor for the capacitor 604, numeral 602 a resistor for blocking reverse current, numeral 603 a discharge resistor, numeral 605 an input resistor for the comparator 603, numerals 606 and 607 resistors for setting the off-timer time level, and numeral 609 a pull-up resistor for the comparator 608, which produces a high level signal for a predetermined length of time after the turning on or off of the idle switch.

Figure 3A:
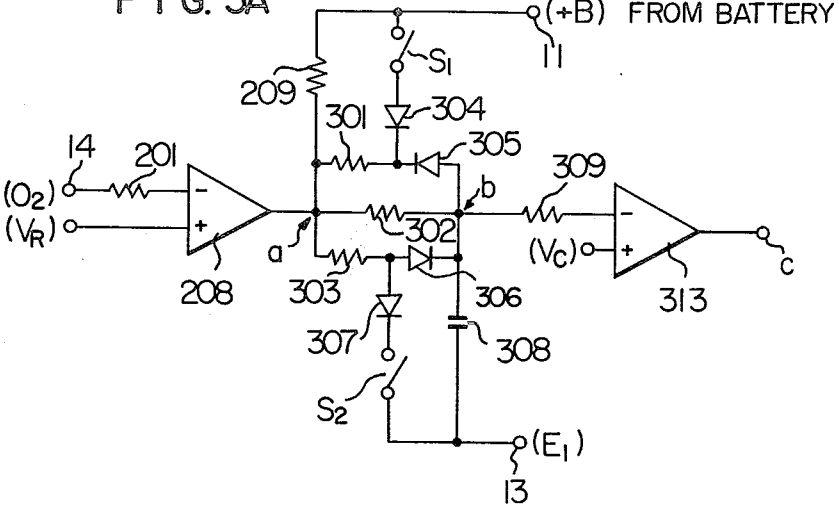
FIG. 3A is a circuit diagram for explaining the operation of the delay circuit 30 shown in FIG. 2.
Figures 3B, 3C:
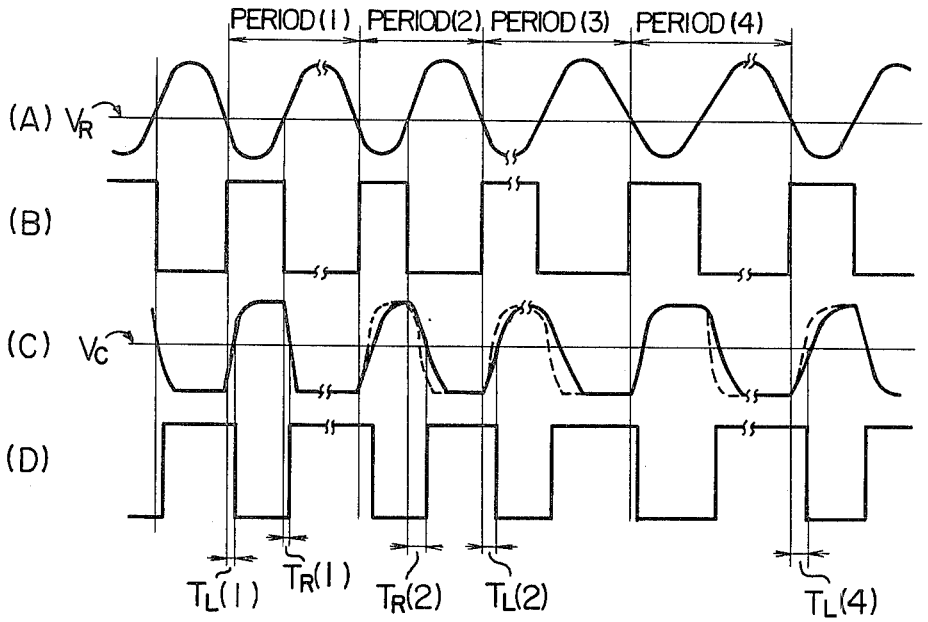
FIGS. 3B(A) to (D) show voltage waveforms produced at various parts for explaining the operation of the delay circuit 30.
FIG. 3C is a table for explaining the function of the delay circuit 30 and shows the relation of on or off state of the change-over switches S1 and S2 in FIG. 3A, the periods (1) to (4) in FIG. 3B and the changes of the delay times $T_R$ and $T_L$.

FIG. 3A illustrates the operation of the delay circuit 30 in FIG. 3. The terminals of the diodes 304 and 307 are connected with change-over switches S1 and S2. FIGS. 3B(A), (B), (C), (D) show voltage waveforms produced at the point 02 (terminal 14), a, b and c in the circuit diagram of FIG. 3A, and FIG. 3C is a table showing the changes of the delay times $T_R$ and $T_L$ depending on the conditions of the change-over switches S1 and S2.

The especially important switching-over of the delay time will be explained with reference to FIGS. 3A, 3B and 3C. In FIG. 3A, the output of the oxygen sensor applied from the input terminal 14 is compared with a predetermined reference voltage (of, say, 0.45 V). When this reference voltage $V_R$ is exceeded, it is discriminated that the air-fuel ratio is "rich", while when the reference voltage $V_R$ is not exceeded, it is discriminated that the air-fuel ratio is "lean". Assume that the output of the oxygen sensor is discriminated to be lower than the reference voltage $V_R$ and lean as in the period (1) of FIG. 3B. The comparator 208 produces a high level as shown in FIG. 3B(B). When the change-over switches S1 and S2 are off, this signal causes the charge-discharge capacitor 308 to be charged through the parallel-connected resistors 302 and 303. In the case where the air-fuel ratio is discriminated to be "rich" by the comparator 208, on the other hand, the output of the comparator 208 is at low level, and therefore the charge-discharge capacitor 308 discharges through the parallel-connected resistors 301 and 302. As a result, the voltage at the point b of FIG. 3A takes the waveform as shown in FIG. 3B(C). When this signal is compared with a fixed reference voltage Vc by the comparator 313, the output at the point c of the comparator 313 is delayed as shown in FIG. 3B(D) by the times $T_L$ and $T_R$ (which are called the "delay times" on the lean side and rich side and given as $T_L(1)$, $T_R(1)$, $T_L(2)$ , . . . $T_L(4)$, $T_R(4)$ corresponding to the periods (1), (2), (3) and (4) respectively) behind the voltage waveform at the point a.

When the change-over switches S1 and S2 are made on in the period (2), the negative (cathode) side of the diode 305 is fixed to +B, and the positive (anodex) side of the diode 306 is fixed to the reference voltage EI, thus preventing the charging of the capacitor 308 through the resistor 303 and the discharging through the resistor 301 in the period (I). In other words, the capacitor 308 is charged and discharged with a time constant due to the charge-discharge capacitor 308 and the resistor 302. Since this time constant is larger than the period (1), the voltage waveform at the point b is delayed larger than the waveform which could be obtained in the period (1) (as shown by the dashed line in FIG. 3B(C)), so that the delay times $T_L$ and $T_R$ for the section (2) are longer than those for the section (1). That is, $T_L(1)<T_L(2)$ and $T_R(1)<T_R(2)$.

Next, assume in the period (3) that the change-over switch S1 is turned on and the switch S2 is turned off. When the charge-discharge capacitor 308 is charged, the delay time is the same as that for the period (1); and when the charge-discharge capacitor 308 is discharged, the delay time is the same as that for the period (2). That is, $T_R(2)=T_R(3)$ and $T_L(1)=T_L(3)$. Further, assume in the period (4) that the change-over switch S1 is turned off and the change-over switch S2 is turned on. When the charge-discharge capacitor 308 is charged, the delay time is the same as that for the period (2); and when the capacitor 308 is discharged, the delay time is the same as that for the period (1). In other words, $T_R(1)=T_R(4)$ and $T_L(2)=T_L(4)$.

As explained above, by turning on and off the change-over switches S1 and S2, the delay times $T_R$ and $T_L$ may be set freely. The relations between the delay times $T_R$ and $T_L$ under the various conditions mentiond above are shown in FIG. 3C.

The operation of the air-fuel ratio feedback control will be explained with reference to FIG. 2. The air-fuel ratio discriminating delayed output produced by the comparator 313 is applied to the integrator 407. The integrator 407 is an inverting integrator. In response to the output of high level of the comparator 313 associated with a rich state, the output of the integrator 407 is integrated to negative side, so that the fuel supply amount is controlled to be reduced by the signal from the terminal (H) 16. In response to an output of low level of the comparator 313 associated with a lean state, on the other hand, the output of the integrator 407 is integrated to positive side, so that the fuel supply amount is controlled to be increased by the resulting output. In this way, the air-fuel ratio is corrected through the integrator 407 in accordance with the rich or lean state detected by the oxygen sensor.

The operation of setting the delay time in accordance with the engine conditions or especially the engine speed will be explained. In the engine rotational speed detector circuit 50, a waveform-shaped engine-speed signal is applied through the engine speed signal terminal Ne, and converted into a DC voltage by a coupling capacitor 502, rectifying diodes 503, 504, a discharge resistor 505, and a rectifying capacitor 506 making up a well-known A/D converter circuit. The resulting DC voltage is compared with the voltage set by the engine speed level setting resistors 508 and 509 when the output of the comparator 608 is at low level.

In the case where the input engine speed signal is higher than a predetermined level of engine speed, the output of the comparator 510 is at low level and the output of the inverter 512 is at high level. When the output of the inverter 512 is at high level, the control diode 304 of the delay circuit 30 is forwardly biased, so that the discharge current from the charge-discharge capacitor 308 to the resistor 301 is cut off. In the case where the engine speed signal is lower than a predetermined engine speed level and the output of the comparator 608 in the idle off timer circuit 60 described later is at low level, the output of the comparator 510 is at high level and the output of the inverter is at low level. Regardless of the engine speed signal, when the output of the comparator 608 in the idle off timer circuit 60 is at high level, the output of the comparator 510 is forcibly raised to high level while the output of the inverter 512 is reduced to low level. In the case where the output of the inverter 512 is at low level, the control diode 304 is reversely biased with the result that the discharge current is supplied from the charge-discharge capacitor 308 through the resistor 301.

Now, the operation of the idle off timer circuit 60 will be explained. When an idle switch-on signal (high level) is applied from the idle switch 4a to the idle switch terminal 15, the voltage at the positive terminal exceeds that at the negative terminal of the comparator 608, and therefore the output of the comparator 608 is raised to high level. Even when an idle-switch off signal (low level) is applied at the time of engine acceleration or steady run, the comparator 608 continues to produce a high-level signal as long as the voltage of the capacitor 604 is discharged through the discharge resistor 603 and higher than the voltage of the divider resistor 606 and 607 (the period of the high-level is referred to "idle-off timer time"). This high level signal of the comparator 608 acts to connect the control diode 307 in reverse direction, thus supplying a charging current through the resistor 303 to the charge-discharge capacitor 308. The high level output of the comparator 608 forcibly raises the positive terminal of the comparator 510 of the speed detector circuit 50 to high level, thus fixing the output of the comparator 510 at high level and the output of the inverter 512 at low level regardless of the engine speed. After the lapse of the idle-off timer time following the turning off of the idle switch, the output of the comparator 608 is reduced to low level.

The low level output of the comparator 608 acts to forwardly bias the control diode 307, and cuts off the charging current to the charge-discharge capacitor 308 via the resistor 303. The low level output of the comparator 608, on the other hand, sets the positive terminal of the comparator 510 of the engine rotational speed detector circuit 50 to a predetermined level of voltage through the resistors 508 and 509. If a DC-converted output voltage of the engine rotational speed signal higher than the set voltage level is produced across the rectifying capacitor 506, the output of the comparator 510 is reduced to low level. Specifically, at a speed higher than a predetermined level (hereinafter referred to as N1), the output of the comparator 510 is reduced to low level, whereas at a rotational speed lower than N1, the output of the comparator 510 is raised to high level.

The aforementioned operations are summarized in the form of values of delay time as related to the engine operating conditions in the table below by reference to FIGS. 3B and 3C.

TABLE I

| | Idle switch off | | Idle switch on |
|---|---|---|---|
| Operating conditions | Higher than or equal to N1 | Lower than or equal to N1 | (or within idle-switch off timer time) |
| Value delay time | Corresponds to period (2) in FIG. 3C | Corresponds to period (4) in FIG. 3C | Corresponds period (1) in FIG. 3C |

As seen from the foregoing description, the idle-off timer circuit detects the turning on of the idle switch and a predetermined length of time after the turning off of the idle switch which is connected to the throttle valve to detect the closed state thereof. The delay-time changing means changes over the delay time to select an optimum delay time according to the engine conditions and in response to the detecting operation of the idle-off timer circuit. Further, the engine speed detector circuit is provided to change over the delay time according to the engine speed. In this way, the feedback corrected output of the integrator 407 is displaced to rich or lean side with respect to the stoichiometric air-fuel ratio, thus correcting the amount of fuel injection by feedback.

In the above-mentioned embodiment, the charging and discharging paths for the charge-discharge capacitor 308 of the delay circuit 30 includes that of resistors 302 and 301 and that of resistors 302 and 303. As an alternative, the charging or discharging paths may be increased in order to set and select an optimum delay time in various ways according to various engine running conditions.

It will be understood from the foregoing description that the air-fuel ratio feedback control system according to the present invention comprises a delay circuit including delay-time changing means adapted to be set in priority in response to a signal from the idle-off timer circuit for detecting the turning on of the idle switch and a predetermined length of time after the turning off of the idle switch which detects the full closed state of the throttle valve, and an engine speed detector circuit for changing and setting the delay time of the delay circuit according to the engine speed, thereby leading to the great advantage that in all operating regions, especially under high-load high-speed running condition, low-load low-speed operating condition, idling, deceleration or for a predetermined time after acceleration, an optimum delay time can be selected by the change-over operation of the changing means as required, so that the air-fuel ratio is feedback controlled to rich or lean side as desired, thus attaining a high degree of purification of the exhaust gas under the steady running state or transient states of the engine.

We claim:

1. An air-fuel ratio feedback control system for an internal combustion engine comprising:

an idle switch for detecting closed state of a throttle valve of the engine;

an oxygen sensor for detecting the oxygen concentration in the exhaust gas;

comparator circuit means for generating a comparison signal related to a comparison of the detection output of said oxygen sensor with a predetermined value;

signal delay means for delaying said comparison signal;

control signal generator means for integrating the output of said delay means and producing a command signal for controlling the amount of fuel supply;

idle-off timer means for detecting the turning on of said idle switch and a predetermined time after the turning off of said idle switch;

engine speed discriminating circuit means for discriminating whether the engine speed is included in a predetermined rotational speed region; and delay-time changing means for independently adjusting the delay time introduced by said delay means of leading and falling edges of said comparison signal in response to said idle-off timer means and said engine speed detector circuit means.

2. An air-fuel ratio feedback control system for an internal combustion engine having a throttle valve, comprising:

an idle switch for detecting closed state of said throttle valve;

idle operation detector means for detecting the turning on of said idle switch and a predetermined length of time after the turning off of said idle switch;

oxygen sensor means for detecting oxygen concentration in the exhaust gas to generate a detection output;

a comparator circuit for comparing the detection output with a reference value to generate either one of a first lean-indication signal and a first rich-indication signal;

discrimination circuit means for discriminating whether the engine speed is included in a predetermined region;

signal delay means for producing either one of a second lean-indication signal and a second rich-indication signal delayed behind said first lean-indication signal and said first rich-indication signal respectively, said delay means including delay-time changing means for independently adjusting the delay time between corresponding leading and falling edges of said first and second lean-indication signals and the delay time between corresponding leading and falling edges of said first and second rich-indication signals in response to said idle operation detector means and said discrimination circuit means; and control signal generator means for producing a signal commanding the increase of the amount of fuel supplied to the engine in response to said second lean-indication signal and producing a signal commanding the decrease of the fuel supplied to the engine in response to said second rich-indication signal.

3. A system according to claim 1 or 2, wherein said delay-time changing means includes capacitor means for charging and discharging in accordance with the output of said comparator circuit means, at least one auxiliary charging path and at least one auxiliary discharging path for promoting the charging and discharging of said capacitor means respectively, first switch means for turning on and off said auxiliary charging path in response to a signal from said discrimination circuit means, and second switch means for turning on and off said auxiliary discharging path in response to said idle switch.

4. A system according to claim 3, wherein said first and second switch means turn off said auxiliary charging path and said auxiliary discharging path respectively in response to a first state representative of the turning on of said idle switch, said first and second switch means turning on said auxiliary charging path and said auxiliary discharging path respectively in response to a second state representative of the turning off of said idle switch and the engine speed higher than a predetermined level, said delay time being longer at the time of said idle switch off than at the time of said idle switch on.

5. A system according to claim 4, wherein said first switch means and said second switch means turn off and on respectively said auxiliary changing path and said auxiliary discharging path in response to the idle switch off and a third state representative of the engine speed lower than a predetermined level, said signal delay means generating under said third state a rich indication signal of a delay time equal in length to that obtained with the time of the idle switch on, and said signal delay means generating under said third state a lean indication signal of a delay time equal to that obtained under said second state.

6. A system according to claim 4, further comprising means for turning on said auxiliary charging path in response to the on state of said idle switch regardless of the engine speed.

7. A system according to claim 1 or 2, wherein said control signal generator means includes an inverting integrator circuit for effecting an inverted integration of the output of said signal delay means.

* * * * *